United States Patent [19]

Walkiewicz, Jr.

[11] 4,138,808

[45] Feb. 13, 1979

[54] RETAINER CLIP FOR INSULATION OR THE LIKE

[75] Inventor: Zigmunt J. Walkiewicz, Jr., Chagrin Falls, Ohio

[73] Assignee: Heleron Corporation, Macedonia, Ohio

[21] Appl. No.: 797,999

[22] Filed: May 18, 1977

[51] Int. Cl.[2] ..... E04D 3/366

[52] U.S. Cl. ..... 52/459; 52/588

[58] Field of Search ..... 52/459–472, 52/404–408, 98, 288, 588, 584, 599, 145, 285

[56] References Cited

U.S. PATENT DOCUMENTS

| | | | |
|---|---|---|---|
| 1,925,418 | 9/1933 | Swank | 52/285 |
| 2,370,379 | 2/1945 | Trippensee | 52/145 |
| 3,574,985 | 4/1971 | Pierce | 52/468 |
| 3,667,177 | 6/1972 | Biela | 52/461 |
| 3,688,460 | 9/1972 | Van Loghem et al. | 52/466 |
| 4,016,689 | 4/1977 | Wendt | 52/145 |

FOREIGN PATENT DOCUMENTS

| | | | |
|---|---|---|---|
| 358577 | 1/1962 | Switzerland | 52/465 |

*Primary Examiner*—James L. Ridgill, Jr.

*Attorney, Agent, or Firm*—McNenny, Pearne, Gordon, Gail, Dickinson & Schiller

[57] ABSTRACT

A retainer strip is disclosed for securing insulation blankets against the wall structure and for concealing the adjacent edges of adjacent blankets and for providing continuity between the vapor bearers. The retainer strip includes a curved cap portion providing oppositely extending flanges which engage the blankets at a location spaced from the edge along a gripping line. This tends to resist movement of the blanket edges out from underneath the retaining strip. The structure is arranged so that a given retainer strip can be used with blankets of varying thicknesses and the strip is adapted for use on a typical "J" lock used in metal buildings or on other types of walls.

14 Claims, 6 Drawing Figures

FIG. 1
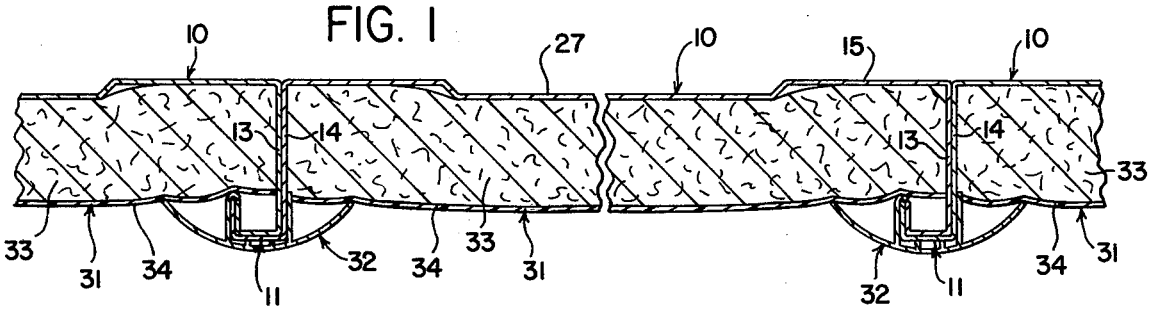
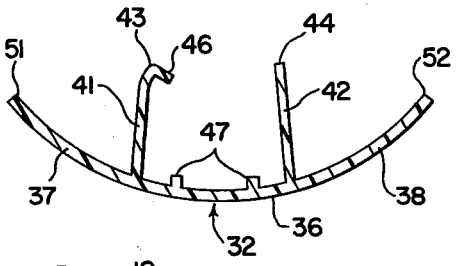
FIG. 2
FIG. 3
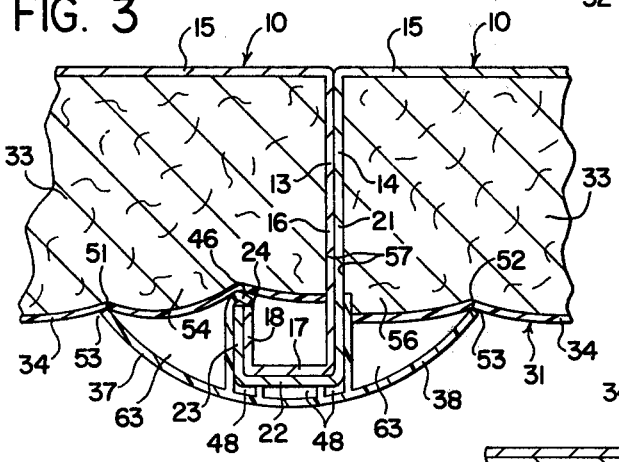
FIG. 4
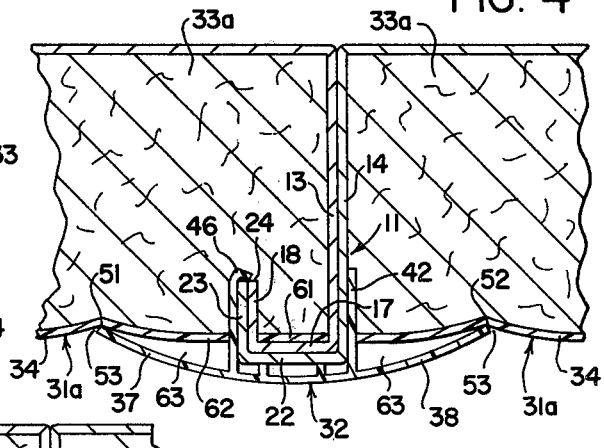
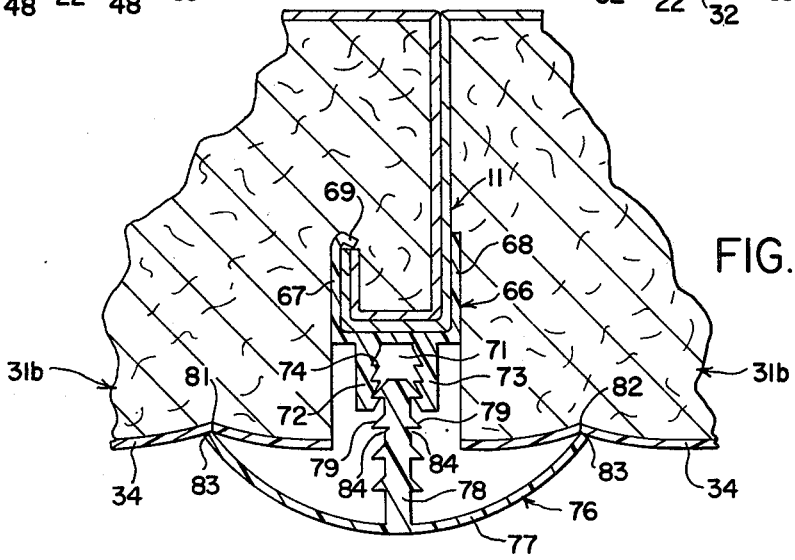
FIG. 5

RETAINER CLIP FOR INSULATION OR THE LIKE

BACKGROUND OF THE INVENTION

This invention relates generally to insulated buildings and more particularly to a retainer strip for securing the insulation blankets against building walls and to a building structure utilizing such retainer strip.

PRIOR ART

Insulation blankets having a facing material are often used to insulate the walls of buildings. In most instances such blankets are secured in place within the wall and are covered by separate interior finishing material such as dry wall or the like. In metal buildings, however, insulation blankets have been widely used to insulate roof structures without separate interior finish material. Such blankets are usually provided with a facing selected to provide an attractive appearance and which also functions as a vapor bearier.

In the past, however, most side walls of metal building have still been constructed with a separate interior finish material over the insulation. However, in some instances retainer clips have been employed to secure the insulation blanket in place along the walls of the metal building without a separate interior wall structure. Prior retainer clips have not functioned satisfactorily in many instances, since the edges of the blanket tended to pull out from under the clip during expansion and contraction caused by temperature changes. Further, such clip could not be used with blankets of different thickness and in particular could not be used with the substantially thicker blankets which are presently being used in many instances because of the increased energy costs created by energy shortages.

SUMMARY OF THE INVENTION

The present invention provides a novel and improved retainer strip for securing insulated blankets in place along a wall and for covering the joint between adjacent blankets. In accordance with this invention a retainer strip is provided with oppositely extending flanges which extend over the face of the adjacent edges of adjacent blankets. Such flanges are shaped to grip the blanket at a location spaced from the edge thereof in such a manner that the tendency for the blanket edges to pull out from under the flanges, as thermal contraction and expansion occur, is virtually eliminated.

Such gripping action also provides a seal which minimizes the tendency for air leakage to occur along the joint between the blanket and provides, with the facing, an effective vapor bearier.

In the illustrated embodiments, the retainer strip is formed as an extrusion of a plastic material such as PVC compounded so that the flanges can be resiliently deflected from their unstressed conditions. The flanges are curved inwardly in the direction toward a blanket when installed and are deformable by the engagement with the blanket so that a single retainer strip can be used with insulation blankets of varying thicknesses. The curved flanges grip the insulation at a location spaced from the insulation edge so that the insulation does not pull out from under the flange and so that the retainer strip provides a sealed joint between adjacent blankets.

In accordance with some illustrated embodiments of this invention, the retainer strip is particularly suited for use along a "J" lock joint between adjacent sidewall panels of a metal building. In such embodiments a strip is provided with a pair of space depending legs which converge slightly toward their extremities when the strip is in the unstressed conditions. One of the legs is provided with a hook portion or flange proportioned to fit over the open end of the "J" lock. Such retainer strip is installed by merely slipping it over the "J" lock and pressing inwardly until the hook portion snaps around the "J" lock to permanently secure the strip in place.

In accordance with other embodiments of this invention, a retainer strip is provided with a central depending projection having means to lock into a mating channel formed in a mounting strip. Such mounting strip may be shaped to be mounted on a "J" lock structure of a metal building or be shaped to be stapled, nailed or otherwise fastened to other types of wall structure. In such embodiment, the length of the central web or projection is selected to provide the proper positioning of the curved flanges for proper gripping of the insulated blanket. Here, again, however, the curved flanges are resiliently formed so that a given strip can accommodate blankets of various thicknesses. The channel and projection interlock is also constructed so that the projection can be inserted into the channel to different depths so that the retainer can adjust for blankets of different thickness. Further, the central projection is preferably provided with a "break" line so that its length can be reduced for use with thinner insulation.

BRIEF DESCRIPTION OF THE DRAWINGS

FIG. 1 is a fragmentary plan view in section illustrating a portion of the metal building wall with one preferred form of retainer strip in accordance with the present invention installed and securing insulation blankets in place;

FIG. 2 is an enlarged cross section of the retainer strip illustrated in FIG. 1 illustrating its shape in its unstressed condition;

FIG. 3 is an enlarged fragmentary section illustrating the retainer strip of FIG. 2 installed with relatively thin insulation;

FIG. 4 is an enlarged fragmentary section similar to FIG. 3 but illustrating the retainer strip installed with thicker insulation;

FIG. 5 is an enlarged fragmentary section of a second embodiment of a retainer strip in accordance with this invention wherein a separate mounting strip is provided and the retainer is securing even thicker insulation in place; and, FIG. 6 is an enlarged fragmentary section illustrating another embodiment of this invention which is particularly suited for installation along flat wall structures.

DETAILED DESCRIPTION OF THE DRAWINGS

Figure 6:
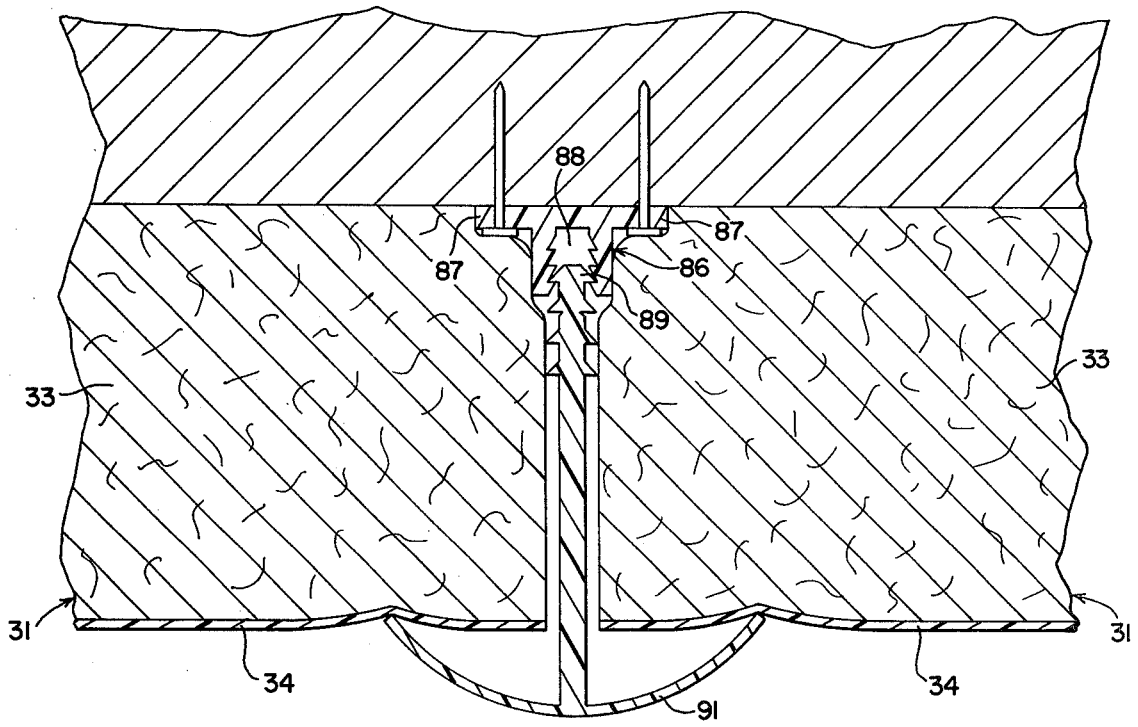

FIGS. 1 through 4 illustrate one preferred embodiment of this invention which is particularly suited for use in retaining insulation blankets along the wall of a metal building having a plurality of vertically extending panels 10 interconnected by a "J" lock 11. Such "J" lock consists of mating "J" shaped parts 13 and 14 which interfit to lock adjacent panels 10 together and such type of lock is well known to persons skilled in the art. The lock part 13 is formed with a lateral wall 16 which extends from the main panel wall 15 to the base of the "J" 17 and a reversed lateral projection 18. The mating lock part 14 is also formed with a first lateral wall 21 which fits against the lateral wall 16, a base wall 22 which fits against the wall 17 and a reversely bent lateral wall 23 which fits against the wall 18. During the construction of the building the panels are interconnected and are secured to the building frame (not illustrated). The open end 24 of the "J" lock provides a surface used by this invention for securing the retainer strip. As illustrated in FIG. 1, the panels 10 are also provided with a lateral offset 27 which is provided in each panel to improve its stiffness.

Positioned adjacent to each panel 10 between its lock portions 13 and 14 is an insulation blanket 31 which is retained in place by a retainer clip 32 incorporating the present invention. Such insulation blankets usually consist of a body of glass fiber 33 with a facing sheet 34 laminated to the outer surface thereof. Such blanket may be manufactured and have a structure disclosed in the U.S. Pat. No. 3,958,385 (assigned to the assignee of the present invention) and such patent is incorporated by reference. The glass fiber body 33 of such blanket is provided with a binder or the like so that the glass fibers tend to assume and retain a position which results in a body of glass fiber which tends to lay flat and resists bending or compression. The glass fiber body, however, can be rolled and/or compressed but provides spring back tending to cause it to return to its straight and uncompressed position to a greater extent than the types of insulation normally used in residential applications. This tendency of the glass fiber body to resist compression is utilized in the present invention.

The facing 34 which is laminated to the glass fiber body 33 functions as a vapor bearier to resist movement of water vapor from the interior of the building into the insulation and in the illustrated embodiments also functions as the interior surface of the building. Such facing may be a plastic sheet formed of vinyl or the like with or without a metal foil layer, suitably treated or laminated kraft paper or any other suitable material. When the facing 34 constitutes the inner exposed wall surface of the building structure, the facing material is selected to provide an attractive appearance and sufficient durability to resist damage during the ordinary wear and tear on the building.

The retainer strip 32 is preferably formed by extrusion of a plastic material such as PVC which is compounded to provide substantial rigidity while allowing the various portions of the retainer strip to be resiliently deformed from their unstressed condition.

Referring to FIG. 2 the retainer strip 32 is formed with a curved cap portion 36 of substantially uniform thickness. Such cap portion, in the illustrated embodiment is formed with a curve which is a segment of a circle and extends in opposite directions from the central part of the cap to provide cantilever supported oppositely extending flanges 37 and 38.

Extending from the center part of the cap portion 36 are two legs 41 and 42 which are spaced apart where they join the cap portion 36 by a distance substantially equal to the width of the "J" lock 11. The two legs converge in their unstressed condition of FIG. 2 as they extend from the cap portion 36 to ends at 43 and 44. The leg 42 is straight and is proportioned to fit along the wall portion 21 of the lock part 14. The end of the leg 41, however, is formed with a lateral flange or hook 46 which is proportioned to snap over the open end of the "J" lock at 24 as best illustrated in FIGS. 3 and 4.

The retainer strip 32 is mounted in place, after the blankets are positioned, by merely spreading the two legs 41 and 42 slightly at one end so that they start in along the opposite sides of the "J" lock and pressing the retainer clip inwardly in a progressive manner along the length of the retainer strip causing the two legs to slide in along the respective wall portions 21 and 23 until the hook portion 46 snaps over the open end of the "J" lock to complete the mounting of the retainer strip. Because the material forming the legs is resiliently deformable, it snugly embraces the sides of the "J" and the hook portion 46 snaps into position as soon as the retainer strip has been pressed into its installed position. The hook portion 46 locks the retainer strip against movement off of the "J" lock and the engagement of the legs with the sides of the "J" lock is sufficiently tight to insure that the retainer strip remains in the mounted position illustrated.

Preferably the cap portion 36 is formed with one or more short ribs 47 between the legs 41 and 42 to maintain the cap portion 36 slightly spaced from the wall portion 22 of the "J" lock to provide air spaces 48 between the metal wall 22 and the cap portion 36 to minimize any heat transfer from the metal "J" lock and the interior or exposed surface of the retainer strip.

Because the oppositely extending flanges 37 and 38 are curved they provide inturned edges at 51 and 52 respectively. Such edges engage and grip the facing of the associated blankets at a gripping line 53 spaced from the edge of the respective blankets. The various elements are proportioned so that when the retainer strip is installed with a blanket of proper thickness a relatively tight contact is provided between the edges 53 and the facing 34 along such gripping line 53 to insure that the edge of the blanket will not slip out from underneath the flange due to thermal expansion and contraction or the like. Such tight gripping is achieved because the contact between the facing and the flange is essentially line contact at the gripping line 53.

As illustrated in the drawings the gripping action of the edges 51 and 52 compresses the glass fiber body 33 below the gripping line 53 and the portions of the glass fiber body at 54 and 56 is bulged out slightly between the gripping line 53 and the edges 57 of the respective blankets. This bulging out of the glass fiber body also assists in resisting any tendency for the edges of the blankets to pull out from underneath the flanges because it would require progressive compression of the glass fiber body as the blanket would tend to pull out. Further, the tendency of the glass fiber body to maintain its normal thickness on the two opposite sides of the gripping line eliminates the tendency for the edges to work out from underneath the flanges by virtue of this tendency to resist compression which is present in the blankets. When required the upper end of the blanket is secured to the panels or framing to prevent the blanket from sagging down.

FIG. 3 illustrates a retainer clip installed with blankets 31 which have a thickness substantially equal to the distance between the open end of the "J" lock at 24 and the exterior wall 15 of the panels 10. In such instance the two flanges 37 and 38 are not deformed significantly from the unstressed condition as illustrated in FIG. 2. However, the retainer strip 32 may also be installed with thicker insulation as illustrated in FIG. 4.

The insulation blanket **31*a* illustrated in FIG. 4 has a greater thickness than the blankets 31 illustrated in FIGS. 1 and 3. Such thickness is increased by utilizing a thicker body of glass fiber 33*a*. In FIG. 4 the thickness of the blankets 31*a* is substantially equal to the total heighth of the "J" lock 11. When installing the blankets 31***a* the edge at 61 is pressed past the open end of the "J" lock at 24 and the insulation body and facing are preferably cut back along the surface of the wall portion 23 by running a sharp knife down along the wall portion before the retainer clip is installed. This allows the edge at 61 to spring outward into the interior section of the "J" lock and also allows the facing at 62 to spring outwardly along the surface of the wall portion 23.

Here, again the retainer strip 32 is pressed into the lock position as illustrated in FIG. 4. However, the greater depth of the insulation blankets causes the flanges 37 and 38 to deform outwardly from their unstressed condition a greater amount than is illustrated in FIGS. 1 and 3. The elastic deformation of the two flanges 37 and 38 therefore allows the use of a given retainer strip 32 with insulation of varying thicknesses.

Here, again, the edges 51 and 52 engage the facing 34 along gripping lines 53 to resist any tendency for the blankets to pull out from underneath the flanges. Because the edges 51 and 52 are inturned, the flanges provide relief sections between the gripping lines 53 and the edges of the blanket which are either spaced from the facing as illustrated at 63 or which engage the facing with lessor pressure than the pressure exerted at the edges 51 and 52. As discussed above, such relief portions inwardly of the edges 51 and 52 contribute significantly to the retaining power of the retainer strip.

The retainer strip because the cap portion is smoothly curved and imperforate, functions to provide an attractive cover for the joint between adjacent blankets. It also provides a vapor tight connection between the facing of one blanket and the adjacent blanket so as to provide continuity of the vapor bearier. Vapor leakage and/or air leakage is virtually eliminated by the engagement between the edges 51 and 52 and the associated facing.

FIG. 5 illustrates another embodiment of the present invention which may be used with insulation blankets 31*b* of even greater thickness. As illustrated the blankets 31*b* have a thickness substantially greater than the depth of the "J" lock 11. In this embodiment, the retainer strip is formed of two separate parts. The first is a mounting strip 66 preferably formed by extrusion from materials similar to the material used to form the retainer strip of the first embodiment. Here, again, the mounting strip is formed with spaced legs 67 and 68 proportioned to slip over a "J" lock in the same manner as in the first embodiment. A hook 69 snaps over the open end of the "J" lock when the mounting strip 66 is installed.

The mounting strip is formed with an elongated socket or channel 71 provided by spaced walls 72 and 73 which are formed with saw-toothed like retaining ridges 74. The other part 76 of the retainer strip is again formed with a curved cap 77 having the similar shape to the cap portion of the first embodiment. A central web or projection 78 is formed in the second part 76 and is proportioned to be snapped into the socket 71 for permanently connecting the two parts 66 and 76 together.

As illustrated the projection 78 is also formed with saw-toothed like ribs 79 which interlock with the ribs 74 when the end of the projection 78 is pressed into the socket as illustrated. The ribs 79 and ridges 74 are arranged to permit locking of the retainer with the projection spaced from the bottom of the channel 71 when used with thicker insulation blankets. When used with thinner insulation the projection can be pressed further into the channel.

Here, again the cap portion provides inturned edges 81 and 82 which engage and grip the facing of the blankets 31*b* at gripping lines 83. In instances where a given retainer strip part 76 is intended for use with insulation blankets of widely differing thicknesses the projection or web 78 is formed so that it is long enough to be usable with a blanket of the maximum thickness expected to be encountered. The projection 78 is formed with one or more breaker sections 84 having a thickness sufficiently small to permit the end of the projection 78 beyond the breaker section to be broken free and removed before installation of the retainer strip part 76. Such breaker line permits the user to break away one or more portions of the projections 78 before installation with a thinner insulation blanket of a given thickness to insure the proper gripping contact with such blanket.

FIG. 6 illustrates still another embodiment in which the retainer strip is again formed of two parts. However, in this instance the mounting part 86 is provided with lateral flanges 87 which permits the mounting part 86 to be nailed, stapled or otherwise suitably fastened to any flat wall surface. Here, again the mounting part 86 is formed with a socket or channel 88 structured to receive and lock with a projection 89 formed on the retainer strip part 91. The embodiment of FIG. 6 is particularly suited for providing additional insulation in existing building structures since it allows the installation to be installed on virtually any type of wall surface. This embodiment permits the easy addition of insulation to existing buildings so as to upgrade the existing building and reduce the energy requirement for heating or cooling the building.

Although preferred embodiments of this invention are illustrated it is to be understood that various modifications and rearrangements may be resorted to without departing from the scope of the invention disclosed and claimed.

I claim:

1. A metal building having wall panels connected by a "J" lock, a pair of insulation blankets positioned against said panels along opposite sides of said "J" lock, said blankets including a glass fiber body which tends to assume an unstressed shape having a predetermined thickness and which is resiliently compressible from said thickness, a vapor barrier facing laminated on said glass fiber body on the side thereof remote from said panels, a retainer strip formed of an extruded body of elastically deformable material, said strip including a curved cap portion adjacent to the side of said blankets remote from said wall panels providing oppositely extending curved flanges terminating at edges which resiliently grip said facing of a blanket along gripping lines spaced from the edge thereof causing compression of said glass fiber body beneath said gripping line while providing substantially less gripping of such blanket between said gripping line and its edge, said retainer strip being mounted on said "J" lock along a zone spaced from and between said edges of said cap portion and extending substantially continuously the entire length thereof, the portions of each blanket between its gripping line and its edge resisting lateral movement of said edge from under said retainer strip, said cap portion providing an imperforate cover completely bridging across the joint between adjacent facings, enclosing the joint between adjacent blankets and also enclosing the associated "J" lock and the mounting of said retainer strip thereon.

2. A wall insulation system comprising a pair of elongated, vapor barrier faced, flexible and compressible insulation blankets adapted to be positioned against a vertical wall with side edges substantially abutting and said vapor barrier on the side remote from said wall, a retainer strip for mounting said blankets in such position against a wall, said retainer strip including an extruded body of elastomerically deformable material, said body including a curved cap portion providing oppositely extending curved flanges terminating at edges operable to grip the vapor barrier of each blanket on the side of the blanket remote from said wall along a gripping line spaced from the edge thereof, said retainer strip compressing said blanket along said gripping line while providing substantially less gripping of said blanket between said gripping line and its edge, and mounting means for securing said body to a building wall along substantially its entire length, along a zone spaced inwardly from said gripping line and along the joint between adjacent blankets after the blankets are positioned against the wall, the portions of each blanket between said gripping line and its edge resisting lateral movement of said blanket from under said retainer strip, said retainer strip operating to provide substantially the entire mounting of said insulation blankets along their lengths against a wall, said cap portion providing an imperforate cover bridging across the joint between adjacent vapor barriers which completely covers the joint therebetween to provide vapor barrier continuity and also completely covers said mounting means.

3. An insulation system as set forth in claim 2 wherein said cap portion is resiliently deformable to accommodate blankets of different thicknesses.

4. An insulation system as set forth in claim 3 wherein said mounting means is adapted to be pressed over and mount on a "J" lock on a metal building or the like.

5. A wall insulation system as set forth in claim 2, wherein said mounting means includes a separate mounting strip adapted to be mounted on said wall, one of said strips including a socket and the other of said strips including a projection, said socket and projection being shaped so that said strips are connected by pressing said socket and projection together.

6. A wall insulation system comprising a pair of elongated, vapor barrier faced, flexible and compressible insulation blankets formed of glass fibers or the like adapted to be positioned against a wall with the vapor barrier on the side remote from said wall, said wall consisting of panels connected by a "J" lock with the adjacent side edges substantially abutting such "J" lock, said glass fibers or the like tending to assume an unstressed shape having a predetermined thickness after being deformed from such shape, a retainer strip for mounting said blankets in such position against said wall, said retainer strip including a body of elastically deformable material, said body including a curved cap portion providing oppositely extending curved flanges terminating at edges operable to grip the vapor barrier of each blanket positioned adjacent to said wall along a gripping line spaced from the edge thereof, said retainer strip engaging said vapor barrier and compressing said blanket along said gripping line while providing substantially less gripping of said blanket between said gripping line and its edge, the portions of each blanket between said gripping line and said edge resisting lateral movement of said edge out from under said retainer strip, said body including a pair of spaced depending legs extending from said cap portion at locations spaced inwardly from the edges thereof and extending along the length thereof adapted to embrace opposite sides of a "J" lock along its length, and an inturned hook on one of said legs operable to snap over the open edge of a "J" lock and secure said strip thereto, said cap portion providing an imperforate cover extending between adjacent vapor barriers to provide vapor barrier continuity and to completely cover the joint therebetween and completely cover said "J" lock along with said depending legs.

7. An insulation system as set forth in claim 6 wherein said legs converge toward each other when said strip is in its unstressed condition.

8. An insulation system as set forth in claim 6 wherein said curved cap portion is provided with ribs between said legs operable to maintain a small space between said "J" lock and said curved cap portion.

9. A retainer strip as set forth in claim 6 wherein said strip is extruded from PVC or the like.

10. A wall insulation system comprising a pair of elongated, flexible and compressible, vapor barrier faced insulation blankets formed of loose glass fibers or the like which tend to return to an unstressed condition after being compressed and to resist compression, said insulation blankets being adapted to be positioned against a wall with the vapor barrier remote therefrom and with adjacent side edges substantially abutting, a retainer strip, elongated mounting means for securing said strip to a building wall along substantially the entire length of a joint between adjacent insulation blankets, said strip providing oppositely extending flanges each of which is proportioned to overlay the adjacent edge of an associated vapor barrier, each flange providing an inturned gripping edge operable to grip the vapor barrier of an associated blanket and compress the associated blanket along a gripping line spaced from the edge of said blanket, said flange being relieved inwardly from said gripping edge so that the portions of an associated blanket between said gripping line and its edge are compressed less than the insulation along said gripping line, said portions of an associated blanket between said gripping line and its edge resisting lateral movement of said blanket with respect to said retainer strip in a direction tending to pull the edge of the blanket out from under the retainer strip, said oppositely extending flanges providing an imperforate cover, providing vapor barrier continuity completely enclosing the joint between adjacent blankets and also completely enclosing said mounting means for securing said strip to a building wall.

11. A retainer strip for mounting insulation blankets along a building wall consisting of panels connected by a "J" lock, comprising an extruded body of elastomerically deformable material, said body including a curved cap portion providing oppositely extending grooved flanges terminating at edges operable to grip the face of an associated blanket along a gripping line spaced from the edge thereof while providing substantially less gripping of said blanket between said gripping line and its edge, a pair of spaced, depending legs extending from said cap portion at locations inwardly spaced from the edges thereof adapted to embrace opposite sides of a "J" lock with a close fit, one of said legs providing a substantially straight inner wall, the other of said legs providing an inturned hook operable to snap over the open edge of a "J" lock and secure said strip thereto along substantially its entire length, and a plurality of ribs extending from said curved cap portion between said legs positioned to engage said "J," lock and operable to maintain a small space between said "J" lock and said curved cap portion, said cap portion providing an imperforate cover over the joint between adjacent blankets and also over the connection between said "J" lock and said legs.

12. A wall insulation system as set forth in claim 11 wherein said projection is formed with a frangible section allowing a portion of said projection be removed to shorten said projection for use with thinner insulation blankets.

13. A wall insulation system as set forth in claim 12 wherein said socket is provided by an elongated channel extending substantially the entire length of said one strip, and said projection extends substantially the entire length of said other strip, and said channel and projection are formed with walls shaped to interlock when said projection is inserted into said channel.

14. A wall insulation system as set forth in claim 13 wherein said strips are formed of extruded material such as PVC or the like.

* * * * *